United States Patent [19]

Wilson

[11] 4,131,288

[45] Dec. 26, 1978

[54] SKATE WITH REPLACEABLE BLADE

[76] Inventor: Stephen G. Wilson, 592 Lemoyne Ave., Beloeil, Quebec, Canada

[21] Appl. No.: 711,201

[22] Filed: Aug. 3, 1976

[51] Int. Cl.[2] ..... A63C 1/30

[52] U.S. Cl. ..... 280/11.17; 280/11.12; 280/11.18

[58] Field of Search ..... 280/11.12, 11.17, 11.18, 280/7.13

[56] References Cited

U.S. PATENT DOCUMENTS

| | | | |
|---|---|---|---|
| 163,308 | 5/1875 | Edwards | 280/11.12 |
| 1,243,077 | 10/1917 | Kuchtik | 280/11.18 |
| 1,275,519 | 8/1918 | Becker | 280/11.17 |
| 1,352,113 | 9/1920 | Brown | 280/11.17 |
| 1,371,608 | 3/1921 | Drevitson | 280/11.12 |
| 1,646,843 | 10/1927 | Winslow | 280/11.17 |
| 1,749,298 | 3/1930 | Orafsik | 280/11.18 |
| 2,242,870 | 5/1941 | Prosey | 280/11.18 |
| 3,036,840 | 5/1962 | Norgiel | 280/11.18 |
| 3,212,786 | 10/1965 | Florsancic | 280/11.12 |

FOREIGN PATENT DOCUMENTS

| | | | |
|---|---|---|---|
| 662510 | 5/1963 | Canada | 280/11.18 |
| 10507 | 10/1956 | Fed. Rep. of Germany | 280/11.18 |
| 199996 | 7/1923 | United Kingdom | 280/11.17 |

*Primary Examiner*—David M. Mitchell
*Attorney, Agent, or Firm*—Charles E. Brown

[57] ABSTRACT

A skate made up of a specially constructed frame and a removably mounted blade of particular construction. The frame is die-cast and has front and rear sole plates, respective front and rear pedestals extending from said sole plates, and a tube-shaped section mounted on the pedestals and provided with a blade-receiving groove presenting side faces and a base face extending therebetween. Each pedestal has a slot extending inward from the groove to receive a tang from the blade. The blade is removably mounted firmly in the groove and has an elongated body provided with an inner face seating on the base face of the groove and rear and intermediate tangs engaging in the pedestal slots and a front tang. The blade has a margin remote from the frame provided with a sharpenable ice-engaging edge. Retaining means acts between the frame and blade to retain the blade firmly in the frame in a way that it can be removed and remounted or replaced by another blade. The retaining means may include registering openings in the rear pedestal and blade tang and removable locking means extending through said openings and means on said front plate for engaging the front blade tang.

3 Claims, 10 Drawing Figures

Fig. 1
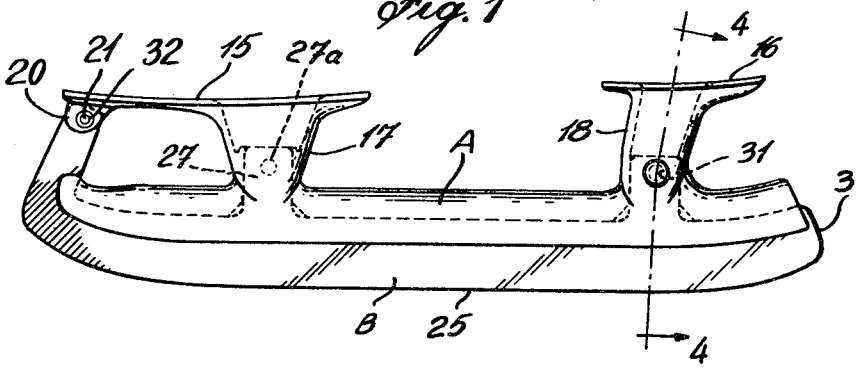
Fig. 2
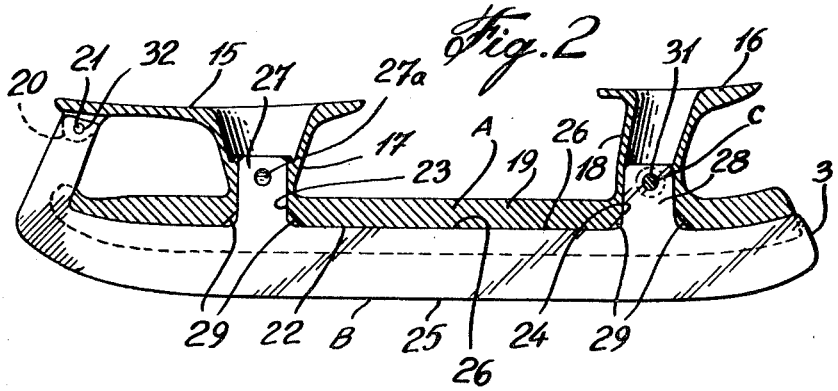
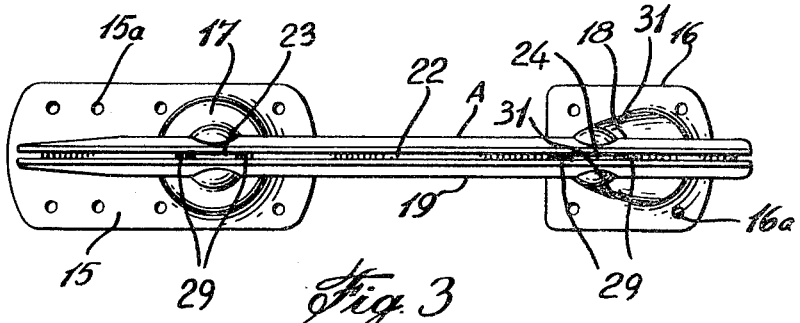
Fig. 3

SKATE WITH REPLACEABLE BLADE

BACKGROUND OF THE INVENTION

1. Field of the Invention

This invention relates to skates.

More specifically, the invention relates to hockey skates.

2. Description of the Prior Art

Hockey skates, as used today, are made up of a frame of die-stamped sheet metal components and a blade which is die-stamped to the desired contour from one-eighth inch nickel chrome sheet material. In making the frame, pedestals are spot-welded to sole plates and to a blade carrying tube. The blade is spot-welded to the tubular section of the frame and a front tang on the blade riveted to two lugs on the front sole plate. The blade and the tube are sweated together with the help of lead solder to give greater holding power.

This construction suffers from several disadvantages. For example, the fact that the frame is made from a number of sheet metal components makes it difficult to maintain a tolerance. This results in a high proportion of rejects and raises the cost. The assembly also involves heat treating the metal to give it greater strength. Another problem is in the finishing of the sides of the stamped blade. This is done by making a single pass along the length of the blade with a buffing apparatus. This also has the undesirable effect of rolling over the working edge of the skate. It is not possible to buff the sides of the blade in the up and down direction because of the presence of the frame. A further disadvantage is that since the blade is permanently fixed to the frame, if anything happens to the blade, the whole skate must be rejected.

SUMMARY OF THE INVENTION

It is an aim of the present invention to avoid these disadvantages and provide certain advantages as will be clear from the following description.

This is accomplished, according to the invention, by providing a skate and components thereof, as will be described. The skate, according to the invention, has a frame and an attachable-detachable blade mounted on it. The frame has front and rear sole plates, front and rear pedestals extending from the sole plates, and a tubular section mounted on the sole plates provided with a blade-receiving groove presenting side faces and a base face extending therebetween. Each pedestal has a slot extending from the groove to receive a tang from the blade. The front sole plate is provided with spaced apart locking lugs and registering transverse locking screw holes. A transverse locking pin hole extends transversely through the rear pedestal. A blade is held in the groove, having an elongated body including a margin provided with a sharpenable ice-engaging edge, side faces abutting the side faces of the groove, and an inner face spaced from the blade margin seating on the base face of the receiving groove. Intermediate and rear tangs protrude from the inner face of the blade and engage in the pedestal slots. A front tang protrudes from the inner face of the blade and is provided with a transverse opening receiving a front locking screw extending through it and said locking lugs. The rear tang is provided with a transverse hole to receive the locking pin and extending through it and the rear pedestal.

Aspects of the invention are also the frame, and the blade having novel features as evident from the foregoing description of the skate as a whole.

Another aspect of the invention is the way in which the rear tang is locked in place. This is done by the use of a special pin having an elongated cylindrical body which extends through the rear pedestal and the opening in the tang on the blade fitting into the opening on the rear pedestal. The locking pin has an elongated cylindrical body provided at one end with a shoulder head which seats on a spot face surrounding the end of the opening in the rear pedestal. At the other end the pin has a terminal part of the same diameter as the body which is provided spaced from the end with an annular groove which receives a resilient locking ring. The locking ring engages a spot face surrounding the other end of the opening in the rear pedestal. The resilience of the locking ring, which is preferably an O-ring normally retains it in position to lock the blade to the skate and can readily be removed while the pin slips out of the openings in the pedestal and blade so that the blade can be detached. To facilitate removal of the O-ring the terminal part of the locking pin is provided with a slot in a plane parallel to the axis of the pin which intersects the groove containing the locking ring. By pushing the flat blade of a tool in the slot it is possible to engage the ring and stretch it outwardly so that it can be removed from its retaining groove.

BRIEF DESCRIPTION OF THE DRAWINGS

Having thus generally described the invention it will be referred to in more detail by reference to the accompanying drawings which illustrate preferred embodiments and in which:

FIG. 1 is a side elevation of a skate, according to the invention;

FIG. 2 is a longitudinal cross-section through the center of the skate shown in FIG. 1;

FIG. 3 is a bottom plan view of the frame of the skate shown in FIGS. 1 and 2;

DESCRIPTION OF THE PREFERRED EMBODIMENTS

Figure 4:
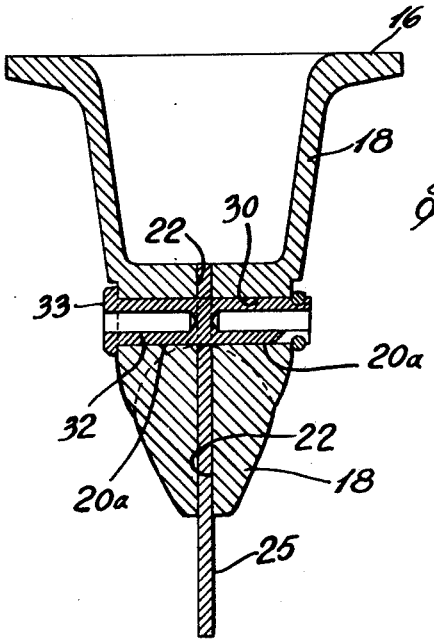
FIG. 4 is a greatly enlarged cross-section along the line 4—4 of FIG. 1.

Referring more particularly to the drawings, the preferred skate illustrated is made up of an aluminum alloy die-cast frame A and a die-stamped chrome nickel sheet metal blade B.

The frame A is made up of front and rear sole plates 15 and 16 respectively for securing the skate to the sole of a boot. These plates are provided with rivet holes **15*a* and 16*a* respectively. From the sole plates 15 and 16 there extend tapered pedestals 17 and 18 respectively. A tube section 19 is mounted on the opposite ends of the pedestals 17 and 18. The front of the sole plate 15 is provided with a pair of downwardly extending blade securing lugs 20 having registering openings 21**.

The tube section 19 is provided with a blade-receiving groove 22 of a width to receive the blade B in a snug fit. The pedestals 17 and 18 are provided with slots 23 and 24 respectively for receiving tangs from the blade B in a snug fit.

The blade B has a margin provided with a sharpenable ice-contacting edge 25. The blade B has an inner face 26 adapted to seat firmly against the linear base of the groove 22. The face 26 is preferably scalloped to lighten the blade. The blade also has tangs 27 and 28 which seat snugly in the slots 23 and 24 respectively.

The amount of play between the thickness of the blade and the slot in which they fit should be kept to not more than about two thousandths of an inch, so that the tangs are kept snugly in their slots. The tangs are the stabilizing influence on the secure fitting of the blade to the frame.

The frame is provided as at 29 with chamfered corners to provide clearance for the radius on the skate blade B.

A locking screw 32 extends through the openings 21 in the lugs 20 and a corresponding opening in the blade B. The rear pedestal 18 is provided with registering openings **20*a* and the tang 28 with a registering opening 31 to receive a locking pin. The intermediate tang has an opening 27*a*** to hold the blade while tooling.

The tang 28 is secured in the slot 24 by means of the pin C as will be described. The pin C has an elongated cylindrical body 33 provided at one end with a shoulder head 34 which seats on a spot face **34*a* surrounding the end of the opening 30 in the rear pedestal. The body 33 at the other end has a terminal part of the same diameter as the body and provided, spaced from the end, with an annular groove 35 which receives a resilient O-ring 36**.

The O-ring 36 acts against a counterbored spot face 38 on the pedestal to prevent retraction of the pin C from the openings 30 and 31. The pin C is also provided with a transversely extending slot 37.

Figure 5:
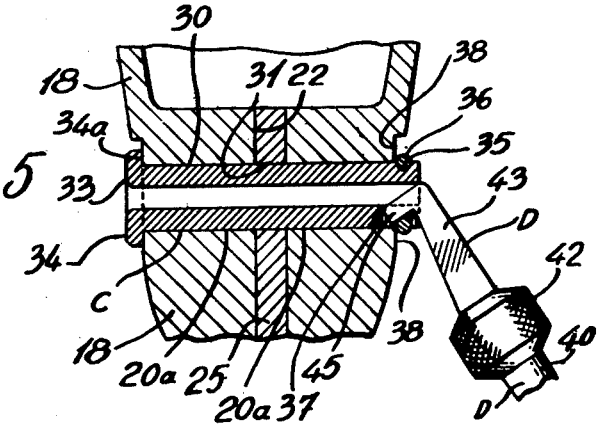
FIG. 5 is a view similar to FIG. 4 but showing the O-ring being removed.

To remove the ring 36, a flat-bladed instrument is introduced into the slot 37 and hooked under the O-ring as shown in FIG. 5, so that the O-ring can be removed freeing the pin C for retraction.

A preferred form of tool for this purpose is shown as D. The tool D is made up of an elongated body 40 having at one end an Allen key 41 swaged into the body 40. The other end of the body is provided with a knurled knob 42 of larger diameter than the body 40. From the knob 42 there extends a flat blade 43 having on its end a hook 45. The key 41 may be used to manipulate the screw 32. The hook 45 may be inserted into the slot 37 to disengage the O-ring.

Figure 6:
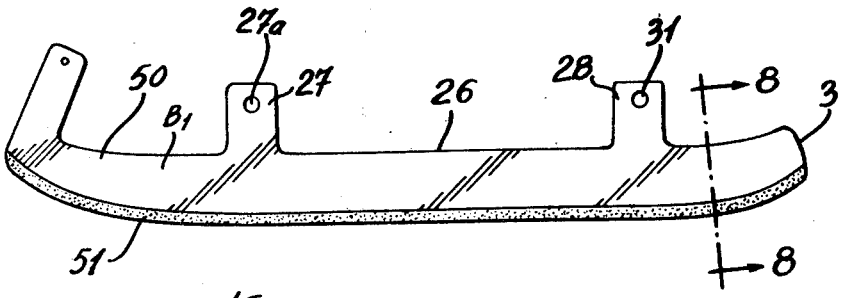
FIG. 6 is a side elevation of another form of skate blade.
Figure 7:
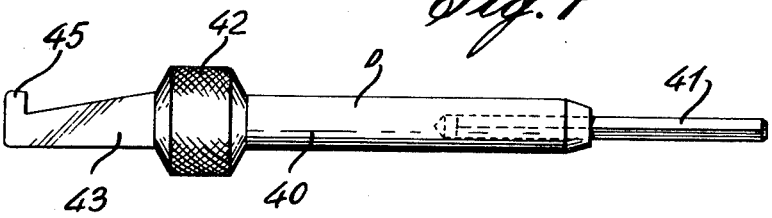
FIG. 7 is a side elevation of a tool for use in dissembling the skate.
Figure 8:
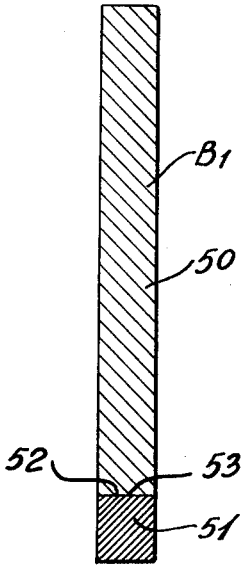
FIG. 8 is an enlarged cross-sectional view taken along the line 8—8 of FIG. 6.

FIG. 6 shows another form of skate blade $B_1$, according to the invention.

This blade is made up of a body 50 of carbon steel and induction brazed to it a carbide strip 51. The surface 52 of the body 50 is brazed to a matched surface 53 of the strip 51 in the usual manner of induction brazing with a silver braze. A specific carbon steel which is preferred is SAE 1045. A specific tungsten carbide which is preferred is 78 B. Such a blade is equal to diamond hardness. The advantage of this construction is that the hardness of the blade enables it to keep its edge for longer without sharpening.

Figure 9:
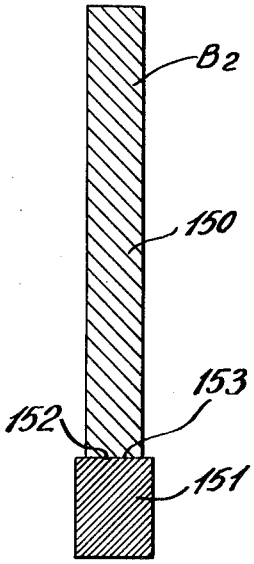
FIG. 9 is an enlarged cross-section, similar to FIG. 7 through a modified form of skate blade.

The blade $B_2$ of FIG. 9 has a chrome nickel steel alloy strip 151 wider than the body 150 of carbon steel and wider than the normal 0.112 inch of a conventional hockey skate. This is for use on soft ice.

Figure 10:
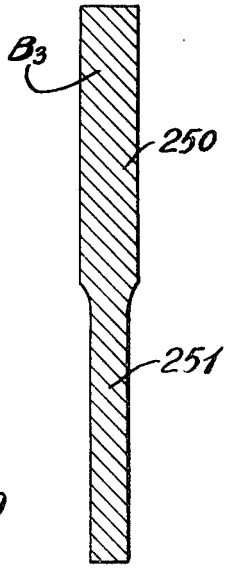
FIG. 10 is an enlarged cross-section through a skate similar to sections of FIGS. 8 and 9, on a skate with a very narrow blade.

In the blade $B_3$ of FIG. 10 the body 250 is all of chrome nickel steel alloy and has a narrowed part 251 providing an edge of reduced width. This is for use on very hard ice.

The die-cast frame A is preferably made of aluminum alloy. The frame may be die-cast in one piece from dies capable of producing two to three frames at a time and up to one hundred frames per hour.

The blanking-die method is used to produce the desired shape of the blade. A shearing operation should be effected prior to heat treating, to true up the blank edge, on the inside contour to match the contour inside the groove of the frame.

An assembled adult hockey skate would weigh about one pound. Shrinkage of the aluminum frame must be calculated and allowed for before designing the tooling or dies. An important feature of the skate is the interchangeability of the blades in all skates of the same size. To this end, proper production processes and tooling are necessary.

The locking-pin material should be of non-corrosive steel, to prevent oxidation. For easy assembly and extraction the pin must preferably have 0.001 clearance in the aluminum frame and blade. Otherwise, the design of the pin is for lightness and for easy removal.

The skate must be correctly aligned on the boot. The design of front and rear sole plates actually makes it possible for all skates to be either left or right. It is desirable that there be a small raised area on the boot sole directly under each sole plate and of the same shape as the sole plate.

Today's tubular hockey skate requires some sixty-seven operations to manufacture. The die-cast method of the invention requires only six operations. The rejection rate of hockey skate components is high because of the large number that have to be put together and the necessity for their matching up with other components. The die-cast skate of the invention is made in one piece and there is no matching up of parts. There are no sharp corners. This eliminates the necessity for plastic protectors. The cost of manufacture is greatly reduced because of the difference in the number of operations and the amount of capital equipment required. The blade design offers the advantage that blades of the same size may be fitted into the frame and yet provide a selection of different type blades to suit different ice conditions. Carbide tip blades can be attached to give greater speed on hard ice and never lose their skating edge. A thin blade can be used for very hard ice and to give greater speed. The wide blade can be used on the same frame for soft ice conditions. As the blade is flat on both sides, it can be ground to a high surface finish at the edges. This results in a very keen edge allowing a hockey player to skate faster without having to wear the skate in after sharpening as with the normal skate.

A hockey player may return to the bench when he has lost his skate edge as by contact with another skate and his damaged blade can be changed to another in less than a minute.

I claim:

1. A skate, comprising:

a frame having front and rear sole plates, front and rear pedestals extending, respectively, from said front and rear sole plates, and a tube-shaped section mounted on said pedestals, said sole plates, pedestals and tube-shaped section comprising a single, integral, die-cast unit;

a blade comprising an elongated body and having front, intermediate and rear tangs extending from one edge of said elongated body, the other edge of said elongated body comprising a sharpenable edge;

said tube-shaped section being provided with a groove for receiving said blade;

each pedestal having a slot extending inwardly from said groove to receive a respective tang of said blade;

said blade being held firmly in said groove with said intermediate tang in said slot of said front pedestal and said rear tang in said slot of said rear pedestal;

and means for removably retaining said blade in said frame, said means for removably retaining comprising:

locking pin holes extending transversely through said rear pedestal on either side of the receiving slot therein;

a registering opening in the rear tang of said blade;

a locking pin extending through the locking pin holes and the registering opening;

said locking pin having a head at one end thereof, the dimensions of said head being greater than the cross-sectional dimensions of said locking pin holes, said head seating on one of the outer surfaces of said rear pedestal;

said locking pin having a groove at the other end thereof for receiving a removable, resilient locking member;

said locking member, when in said groove, engaging a second outer surface of said rear pedestal to retain the pin in position.

2. A skate as defined in claim 1 wherein said locking pin holes are cylindrical, and wherein said locking pin comprises a cylindrical body, said head at the one end of said locking pin being circular in shape.

3. A skate, as defined in claim 1, in which said resilient locking member is an elastomeric O-ring and said other end is provided with a slot transverse to said groove to provide access beneath said O-ring for engaging and dislodging it.

* * * * *